US006439687B1

(12) United States Patent
Inoue

(10) Patent No.: US 6,439,687 B1
(45) Date of Patent: Aug. 27, 2002

(54) INK-JET PRINTER AND PRINTING HEAD DRIVING METHOD THEREFOR

(75) Inventor: Takashi Inoue, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/605,370

(22) Filed: Jun. 29, 2000

(30) Foreign Application Priority Data

Jul. 2, 1999 (JP) ..... 11-189634

(51) Int. Cl.[7] ..... B41J 2/15
(52) U.S. Cl. ..... 347/41; 347/12; 347/40
(58) Field of Search ..... 347/41, 12, 40, 347/43, 9, 10, 237, 145

(56) References Cited

U.S. PATENT DOCUMENTS

| | | | | |
|---|---|---|---|---|
| 4,313,124 A | | 1/1982 | Hara | 347/9 |
| 4,345,262 A | | 8/1982 | Shirato et al. | 347/10 |
| 4,459,600 A | | 7/1984 | Sato et al. | 347/47 |
| 4,463,359 A | | 7/1984 | Ayata et al. | 347/56 |
| 4,558,333 A | | 12/1985 | Sugitani et al. | 347/65 |
| 4,723,129 A | | 2/1988 | Endo et al. | 347/56 |
| 4,740,796 A | | 4/1988 | Endo et al. | 347/56 |
| 5,359,355 A | * | 10/1994 | Nagoshi et al. | 347/9 |
| 5,917,519 A | * | 6/1999 | Arai et al. | 347/41 |
| 6,027,197 A | * | 2/2000 | Kaburagi et al. | 347/9 |
| 6,126,261 A | * | 10/2000 | Yamanaka | 347/12 |
| 6,172,701 B1 | * | 1/2001 | Tokura et al. | 347/237 |

FOREIGN PATENT DOCUMENTS

| | | |
|---|---|---|
| JP | 54-56847 | 5/1979 |
| JP | 59-123670 | 7/1984 |
| JP | 59-138461 | 8/1984 |
| JP | 60-71260 | 4/1985 |

* cited by examiner

*Primary Examiner*—Lamson D. Nguyen
(74) *Attorney, Agent, or Firm*—Fitzpatrick, Cella, Harper & Scinto

(57) ABSTRACT

An ink-jet printer for printing by scanning a printing head having a plurality of nozzles arranged in a predetermined direction, each designed to discharge an ink droplet (100), over a printing medium in a direction substantially perpendicular to the array direction of the nozzles includes a driving means for time-divisionally driving the nozzles in accordance with driving signals (300) with timings of a plurality of blocks. When multipass printing is performed by scanning different nozzles over each printing area a plurality of times, the driving means drives nozzles used to print the same raster at timings of at least two different blocks. This makes it possible to reduce density unevenness of a printed image due to periodic ink pressure variations.

8 Claims, 10 Drawing Sheets

INK-JET PRINTER AND PRINTING HEAD DRIVING METHOD THEREFOR

FIELD OF THE INVENTION

The present invention relates to an ink-jet printer (printing apparatus) and a printing head driving method therefor and, more particularly, to an ink-jet printer for printing by scanning a printing head having a plurality of nozzles arranged in a predetermined direction, each designed to discharge ink droplets, over a printing medium in a direction almost perpendicular to the array direction of the nozzles, and a printing head driving method for the apparatus.

BACKGROUND OF THE INVENTION

As an information output apparatus used for a wordprocessor, personal computer, facsimile, or the like, a printer is available, which prints desired information such as characters and images on a printing medium such as paper or film.

As printing schemes for printers, various schemes such as a dot-impact scheme, thermal scheme, ink-jet scheme are known. The ink-jet printing scheme is one of so-called non-impact printing schemes, and has the following advantages. The noise generated in printing operation is negligibly low. High-speed printing and printing on various recording media can be performed. Images can be fixed on even so-called plain paper without any special process. In addition, high-precision images can be obtained at low cost.

Owing to these advantages, printers using the ink-jet scheme have rapidly become popular in recent years as printers for copying machines, facsimiles, wordprocessors, and the like as well as printers serving as peripheral devices of computers.

Generally used ink discharging methods in the ink-jet printing scheme include a method of using electrothermal transducers (heaters) and a method of using piezoelectric elements. In either method, discharging of ink droplets is controlled by electrical signals.

According to the principle of ink droplet discharging operation using electrothermal transducers, when an electrical signal is supplied to a given electrothermal transducer, ink near the electrothermal transducer is instantaneously boiled (film boiling), and an ink droplet is discharged at high speed upon abrupt growth of a bubble produced by a phase change of the ink at this time. This method therefore has the advantages of, e.g., simplifying the structure of an ink-jet printing head and facilitating integration of nozzles.

In order to implement high-density printing, an ink-jet printing head often has a plurality of nozzles for discharging ink and discharge pressure generating elements. In general, a divisional driving scheme is employed, in which these nozzles are grouped into sections, each having a predetermined number of nozzles, in accordance with their physical positions, the nozzles in each section are further grouped into driving blocks, and the discharge pressure generating elements are time-divisionally driven in units of driving blocks. This divisional driving scheme is an effective scheme in achieving reductions in the sizes of power supply members such as a power supply for driving the printing head, a connector, and a cable.

In an ink-jet printing head using electrothermal transducers, in particular, variations in voltage value in a power supply for discharge pressure generating elements must be minimized, and the voltage value must be finely adjusted in order to implement stable discharging operation in consideration of the characteristics of the electrothermal transducer, ink, and the like. For this reason, a large power supply capacity is not preferable. The above divisional driving scheme is also effective in satisfying such requirements for a power supply.

A case wherein an ink-jet printing head is driven by the divisional driving scheme will be described in more detail below with reference to the accompanying drawings.

FIGS. 4A to 4C schematically show the nozzle array of the ink-jet printing head, driving signals for the respective nozzles, and flying ink droplets discharged from the respective nozzle, respectively. Referring to FIG. 4A, a nozzle array 500 of the ink-jet printing head is made up of, e.g., 32 nozzles, and these nozzles are grouped into four sections each having eight nozzles, from the first section to the fourth section, when viewed from the upper side of FIG. 4A.

In addition, each of the eight nozzles in each section belongs to one of eight driving blocks, and the nozzles are time-divisionally driven in units of blocks in printing operation. That is, the nozzles in the same block are simultaneously driven.

In the case shown in FIG. 4A, nozzles are periodically assigned to the respective driving blocks such that, for example, four nozzles, i.e., the 1st, 9th, 17th, and 25th nozzles of the nozzle array 500 are assigned to the first driving block, and 2nd, 10th, 18th, and 26th nozzles are assigned to the eighth driving block. The first to eighth driving blocks are sequentially driven in ascending order by pulse-like driving signals 300 shown in FIG. 4B, and ink droplets 100 are discharged from the respective nozzles in accordance with the driving signals, as shown in FIG. 4C.

Each nozzle has its unique characteristics associated with the discharge direction of ink droplets, the amount of ink discharged, and in the like. Such characteristics unique to each nozzle affect printed images, and may cause streaking, density unevenness, and the like. In order to eliminate such adverse influences on printed images, a multipass printing method is used, in which the ink-jet printing head is scanned over a printing area a plurality of times to print the same raster with two or more different nozzles.

An ink-jet printer is required to be kept in a state wherein ink can always be discharged stably. In some case, when ink is discharged by a discharge pressure generating element, variations in pressure due to the discharging of the ink vibrate the ink in an adjacent liquid channel through a common liquid chamber. If, therefore, the discharge pressure generating element disposed in the adjacent liquid channel is continuously driven, the pressure variations make discharging operation unstable, resulting in a change in ink discharge amount.

A change in ink discharge amount causes density unevenness in a printed image. Variations in ink discharge amount due to variations in ink pressure become more noticeable as the number of nozzles to be continuously and simultaneously driven increases. In addition, such variations are greatly influenced by the distances from the ink supply ports, the shape of the common liquid chamber communicating with the orifices, and the positions and sizes of residual bubbles in the common liquid chamber.

When the number of nozzles to be simultaneously driven greatly changes, the flow rates of ink into the liquid chambers vary. Such variations vibrate the meniscus surfaces of the nozzles through the common liquid chamber. As a consequence, discharging operation becomes unstable, and the amounts of inks discharged change, resulting in density unevenness in a printed image.

With regard to this change in discharge amount, experiments conducted by the present inventors confirmed that uneven density portions of a printed image depend on driving blocks. FIG. 5 is a graph showing driving signals for causing all the nozzles to periodically discharge ink droplets at predetermined intervals and the distances between meniscus surfaces and the orifices as functions of time. As shown in FIG. 5, with regard to driving blocks 1 to 3 belonging to the first half group, the meniscus position corresponds to a convex shape with respect to the orifice surface, whereas with regard to driving block 6 belonging to the second half group, the meniscus position corresponds to a concave shape with respect to the orifice surface. In this manner, each driving block has each specific meniscus state. This uneven pattern of meniscus directly corresponds the magnitude of discharge amount.

As described above, the method of time-divisionally driving is used for discharge pressure generating elements. In general, these elements are periodically arranged on a printing head substrate in a predetermined order. Owing to periodical ink pressure variations, therefore, periodic density unevenness occurs in a printed image. In printing an image by multipass printing, in particular, if a combination of driving blocks of nozzles for scanning the same raster is constituted by only blocks exhibiting large discharge amounts, density unevenness in a printed image becomes more noticeable.

In order to reduce such influences of changes in ink pressure in liquid chambers on printed images, the common liquid chamber is broadened or the physical distances between adjacent discharge pressure generating elements and time intervals at which the elements are driven are increased. This makes it difficult to attain a further reduction in printing head size and a further increase in printing speed.

SUMMARY OF THE INVENTION

It is, therefore, an object of the present invention to provide an ink-jet printing apparatus which can reduce density unevenness of a printed image due to periodic ink pressure variations, and a printing head driving method for the ink-jet printing apparatus.

According to the present invention, the above and other objects are achieved by an ink-jet printing apparatus for printing by scanning a printing head having a plurality of nozzles arranged in a predetermined direction, each designed to discharge an ink droplet, over a printing medium in a direction substantially perpendicular to an array direction of the nozzles, comprising driving means for time-divisionally driving the nozzles at timings of a plurality of blocks, wherein when multipass printing is performed by scanning different nozzles over each printing area a plurality of times, the driving means drives nozzles used to print the same raster at timings of at least two different blocks.

In addition, the above objects are also achieved by a printing head driving method for an ink-jet printing apparatus for printing by scanning a printing head having a plurality of nozzles arranged in a predetermined direction, each designed to discharge an ink droplet, over a printing medium in a direction substantially perpendicular to an array direction of the nozzles, comprising the driving step of time-divisionally driving the nozzles at timings of a plurality of blocks, wherein when multipass printing is performed by scanning different nozzles over each printing area a plurality of times, the driving step comprises driving nozzles used to print the same raster at timings of at least two different blocks.

According to the ink-jet printing apparatus of the present invention, in a driving scheme of time-divisionally driving the nozzles at timings of a plurality of blocks in multipass printing operation in which printing is performed by a plurality of times of scanning, nozzles used to print the same raster are driven at timings of at least two different blocks.

Proportionally distributing driving blocks used to print each rater in this manner can compensate for variations in printing density due to the differences in ink discharge amounts which are dependent on the respective printing timings, thereby reducing density unevenness. More specifically, high-density printing and low-density printing are alternately performed, and each raster is printed by four printing operations in an overlapped state. As a consequence, density differences among the rasters are canceled out, and each raster has an almost uniform average density, thus improving print quality.

The driving means preferably drives the nozzles used to print the same raster at timings of different blocks.

More specifically, when numbers are assigned to the blocks in a driving sequence, the numbers of the blocks for driving the nozzles used to print the same raster are preferably constituted by a pair of a number belonging to a first half group and a number belonging to a second half group.

When numbers are assigned to the blocks in a driving sequence, the sum of the numbers of the blocks for driving the nozzles used to print the same raster preferably remains unchanged among the respective rasters.

In addition, the number of times of scanning in the multipass printing operation is preferably an even number.

The number of blocks is preferably a number obtained by dividing the number of nozzles by the number of times of scanning.

The numbers of the blocks for driving the nozzles used to print the same raster may be complementary to each other between two adjacent rasters.

Other features and advantages of the present invention will be apparent from the following description taken in conjunction with the accompanying drawings, in which like reference characters designate the same or similar parts throughout the figures thereof.

BRIEF DESCRIPTION OF THE DRAWINGS

The accompanying drawings, which are incorporated in and constitute a part of the specification, illustrate embodiments of the invention and, together with the description, serve to explain the principles of the invention.

DETAILED DESCRIPTION OF THE PREFERRED EMBODIMENTS

Preferred embodiments of the present invention will now be described in detail in accordance with the accompanying drawings.

Figure 1:
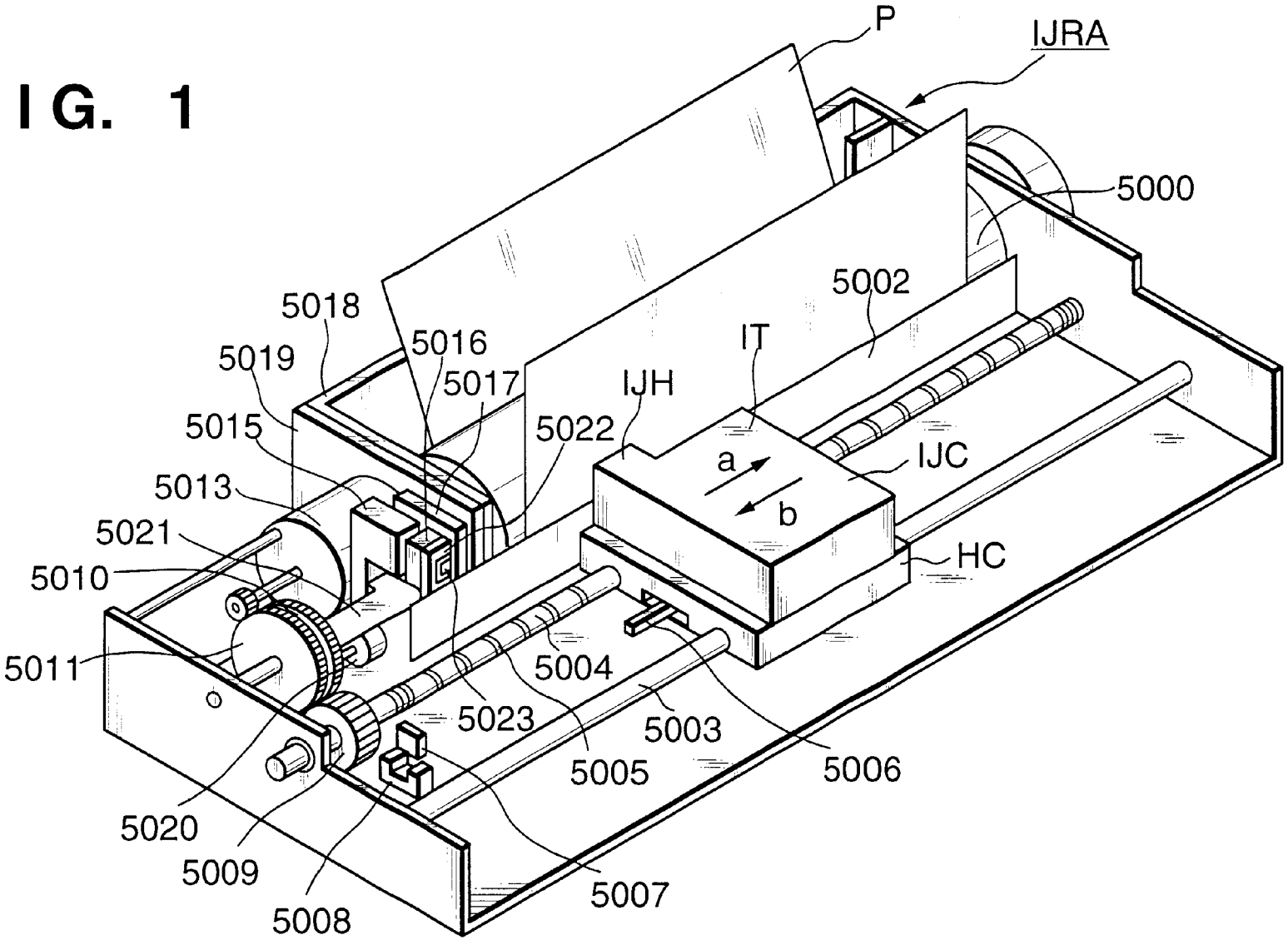
FIG. 1 is a perspective view showing the arrangement of an ink-jet printer according to a preferred embodiment of the present invention.

FIG. 1 is a perspective view showing a schematic arrangement of an ink-jet printer IJRA according to a preferred embodiment of the present invention. Referring to FIG. 1, a carriage HC is engaged with a helical groove 5004 of a lead screw 5005 which rotates upon clockwise/counterclockwise rotation of a driving motor 5013 through driving force transmission gears 5009 to 5011. The carriage HC has a pin (not shown) and reciprocally moves in the directions indicated by arrows a and b while being supported on a guide rail 5003. An integrated ink-jet cartridge IJC incorporating a printing head IJH and ink tank IT is mounted on the carriage HC.

Reference numeral 5002 denotes a paper press plate for pressing printing paper P against a platen 5000 throughout the moving direction of the carriage HC; and 5007 and 5008, photocouplers serving as a home position detector for recognizing the presence of a lever 5006 of the carriage in this area to, for example, change the rotating direction of the driving motor 5013.

Reference numeral 5016 denotes a member for supporting a cap member 5022 for capping the front surface of the printing head IJH; 5015, a suction device for sucking out air from the cap member and performing suction recovery for the printing head through a cap opening 5023; 5017, a cleaning blade; and 5109, a member for allowing the blade to move back and forth. These components are supported on a body support plate 5018. As is obvious, instead of the blade in this form, a known cleaning blade can be applied to this embodiment.

Reference numeral 5021 denotes a lever for starting suction for suction recovery. The lever 5021 moves upon movement of a cam 5020 engaged with the carriage. A driving force from the driving motor is controlled by a known transmission mechanism for clutch switching and the like, thereby controlling the movement of the lever.

As the capping, cleaning, and suction recovery, desired processes are performed at corresponding positions by the function of the lead screw 5005 when the carriage comes to the home position area. However, if desired operations are performed at known timings, each operation can be applied to this embodiment.

A control arrangement for executing printing control of the above apparatus will be described next.

Figure 2:
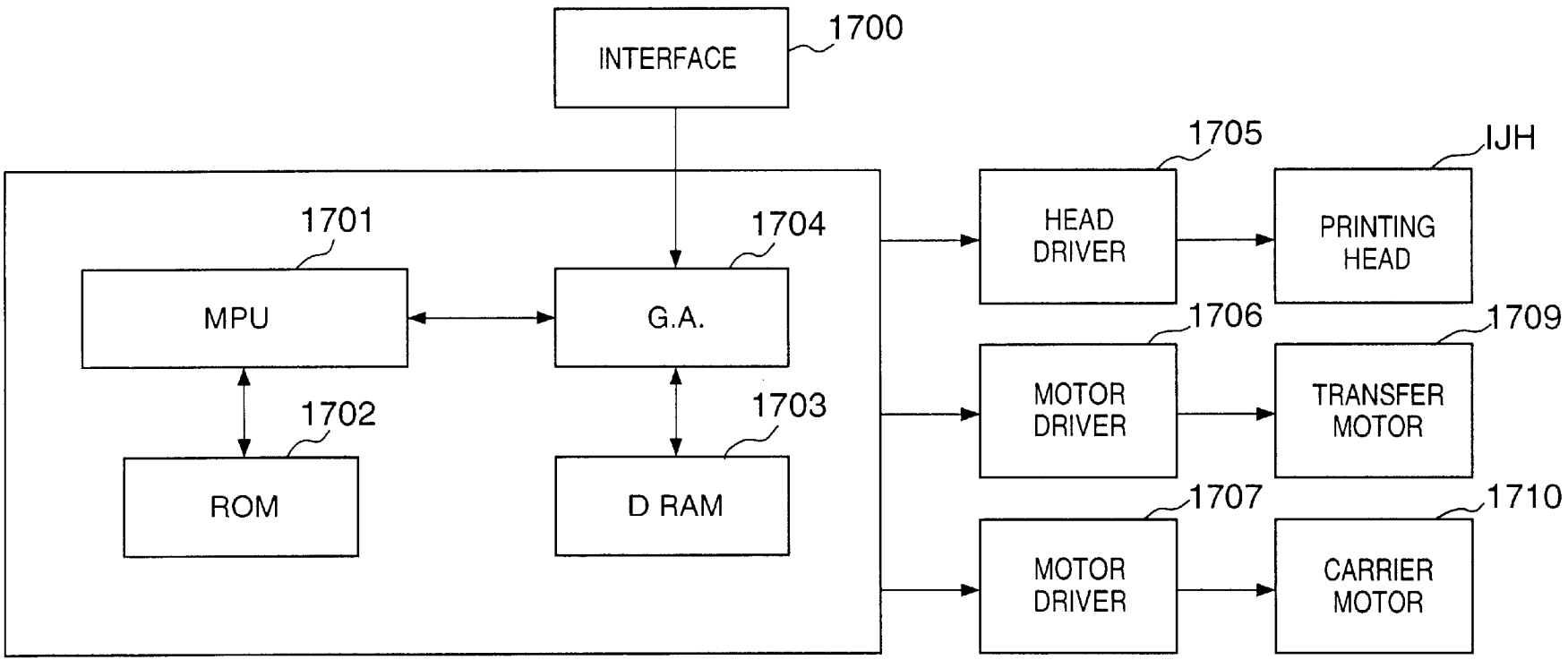
FIG. 2 is a block diagram showing the arrangement of the control unit of the printer in FIG. 1.

FIG. 2 is a block diagram showing the arrangement of the control circuit of the ink-jet printer IJRA. Referring to FIG. 2 showing the control circuit, reference numeral 1700 denotes an interface for inputting a printing signal; 1701, an MPU; 1702, a ROM storing control programs executed by the MPU 1701; 1703, a DRAM for storing various data (the printing signal, printing data supplied to the printing head, and the like); 1704, a gate array (G. A.) for controlling the supply of printing data and also controlling data transfer between the interface 1700, the MPU 1701, and the DRAM 1703; 1710, a carrier motor for moving a printing head 1708; 1709, a feed motor for feeding printing paper; 1705, a head driver for driving the printing head; and 1706 and 1707, motor drivers for driving the feed motor 1709 and carrier motor 1710, respectively.

The operation of the above control arrangement will be described. When a printing signal is input to the interface 1700, it is converted into printing data for printing operation between the gate array 1704 and the MPU 1701. As the motor drivers 1706 and 1707 are driven, the printing head is driven in accordance with the printing data supplied to the head driver 1705, thereby printing.

In this case, the control programs to be executed by the MPU 1701 are stored in the ROM 1702. However, a programmable storage medium such as an EEPROM may be added to the above arrangement to allow a host computer connected to the printer to change the control programs.

The ink tank IT and printing head IJH may be integrated into the exchangeable ink-jet cartridge IJC, as in the above case. However, the ink tank IT and printing head IJH may be configured to be detachable to allow only the ink tank IT to be replaced when ink runs out.

Figure 3:
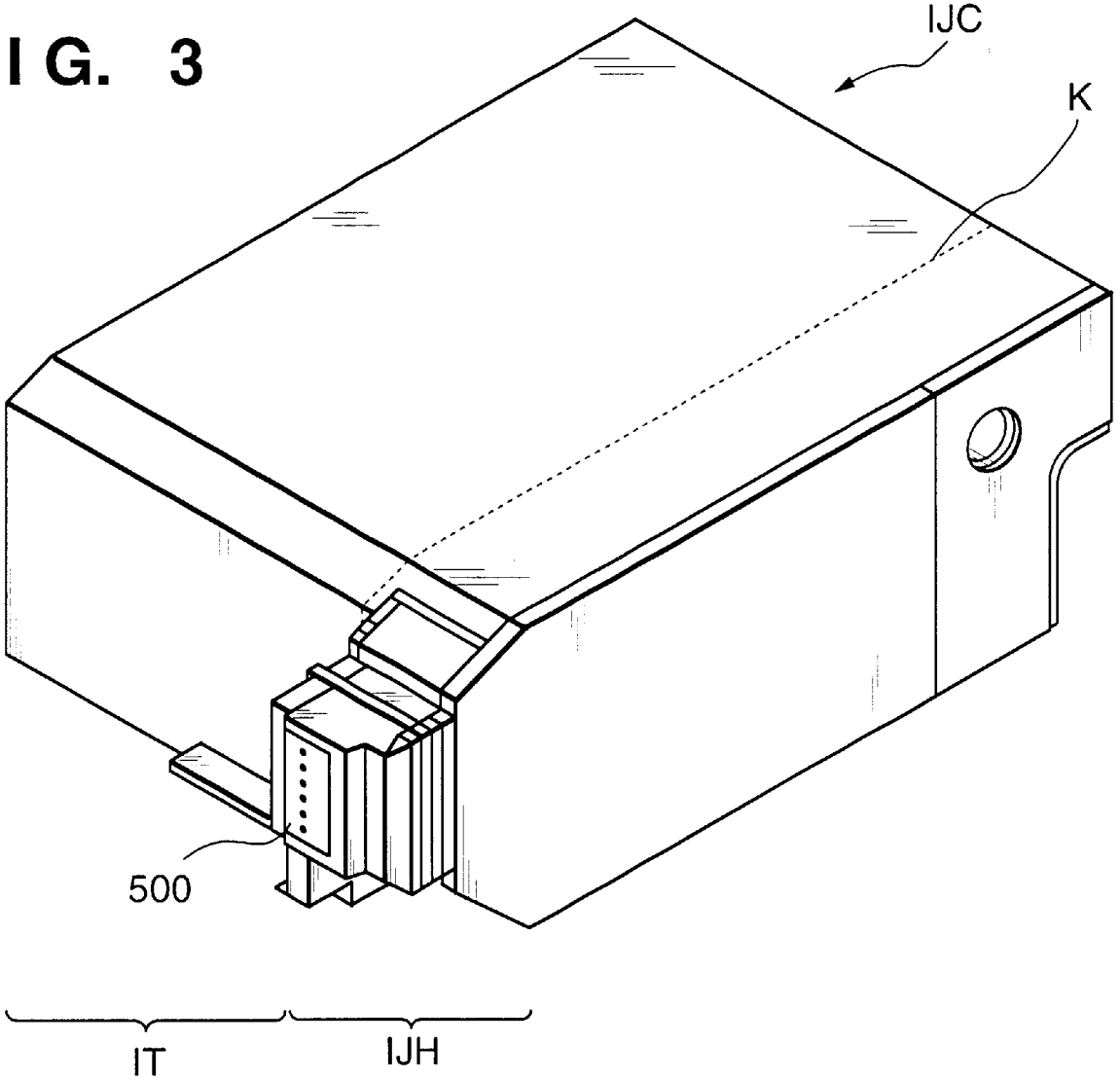
FIG. 3 is a perspective view showing the arrangement of an ink cartridge.

FIG. 3 is a perspective view showing the arrangement of the ink-jet cartridge IJC designed such that the ink tank and head can be detached from each other. As shown in FIG. 3, the ink-jet cartridge IJC is designed such that the ink tank IT and printing head IJH can be detached from each other at the position of a boundary. The ink-jet cartridge IJC has an electrode (not shown) for receiving an electrical signal supplied from the carriage HC side when the carriage is mounted on the carriage HC. With this electrical signal, the printing head IJH is driven to discharge ink, as described above.

Referring to FIG. 3, reference numeral 500 denotes an orifice array. The ink tank IT has a fibrous or porous ink absorber for holding ink. The ink is held by this ink absorber.

A printing head driving method in this embodiment will be described in detail next. A printing head having eight driving blocks and four sections, i.e., an 8×4(=32) nozzle arrangement, will be described as an example in comparison with the prior art.

Figures 4A, 4B, 4C:
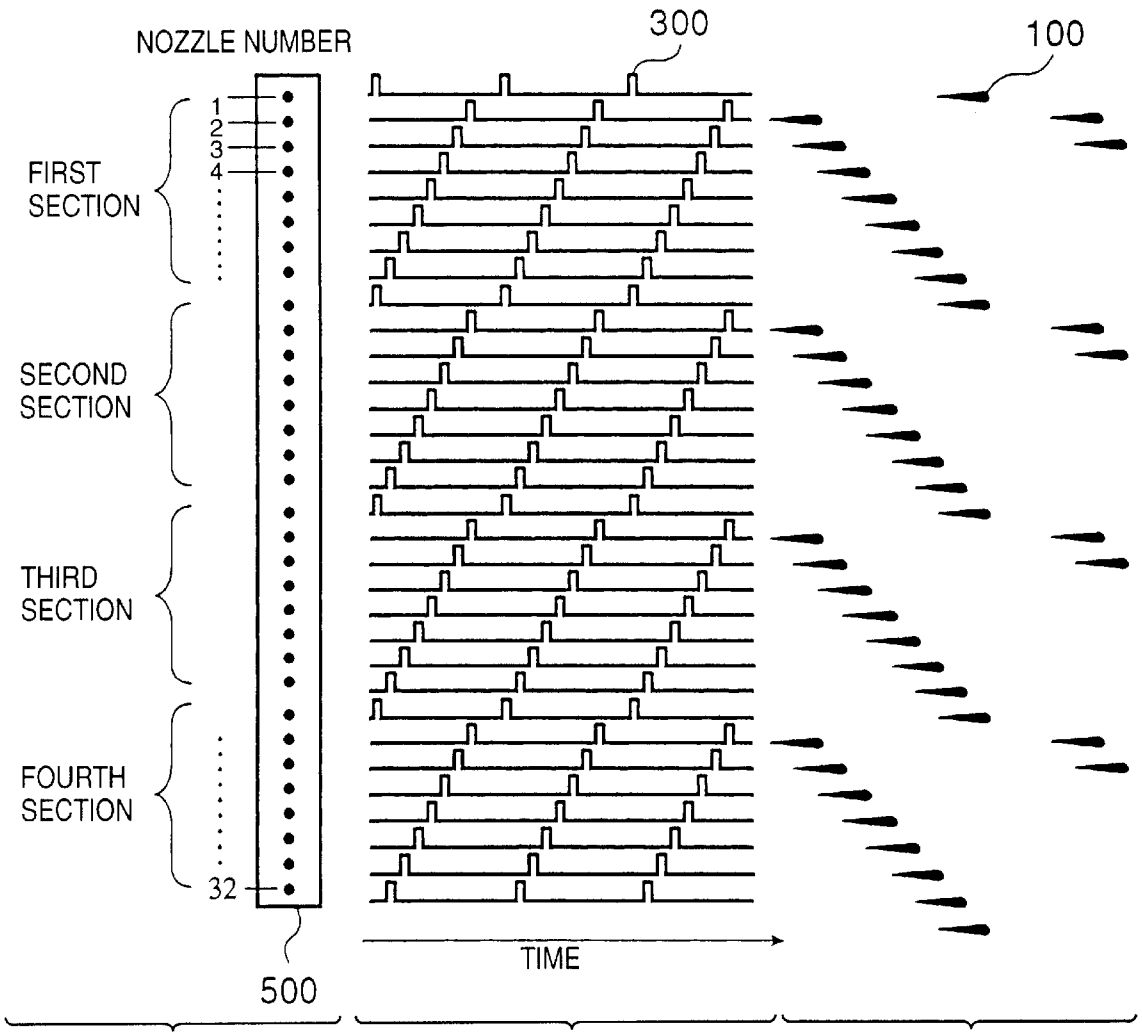
FIGS. 4A to 4C are views schematically showing the nozzle array of a conventional ink-jet printer, driving signals for the respective nozzles, and flying ink droplets discharged from the respective nozzles, respectively.
Figure 7:
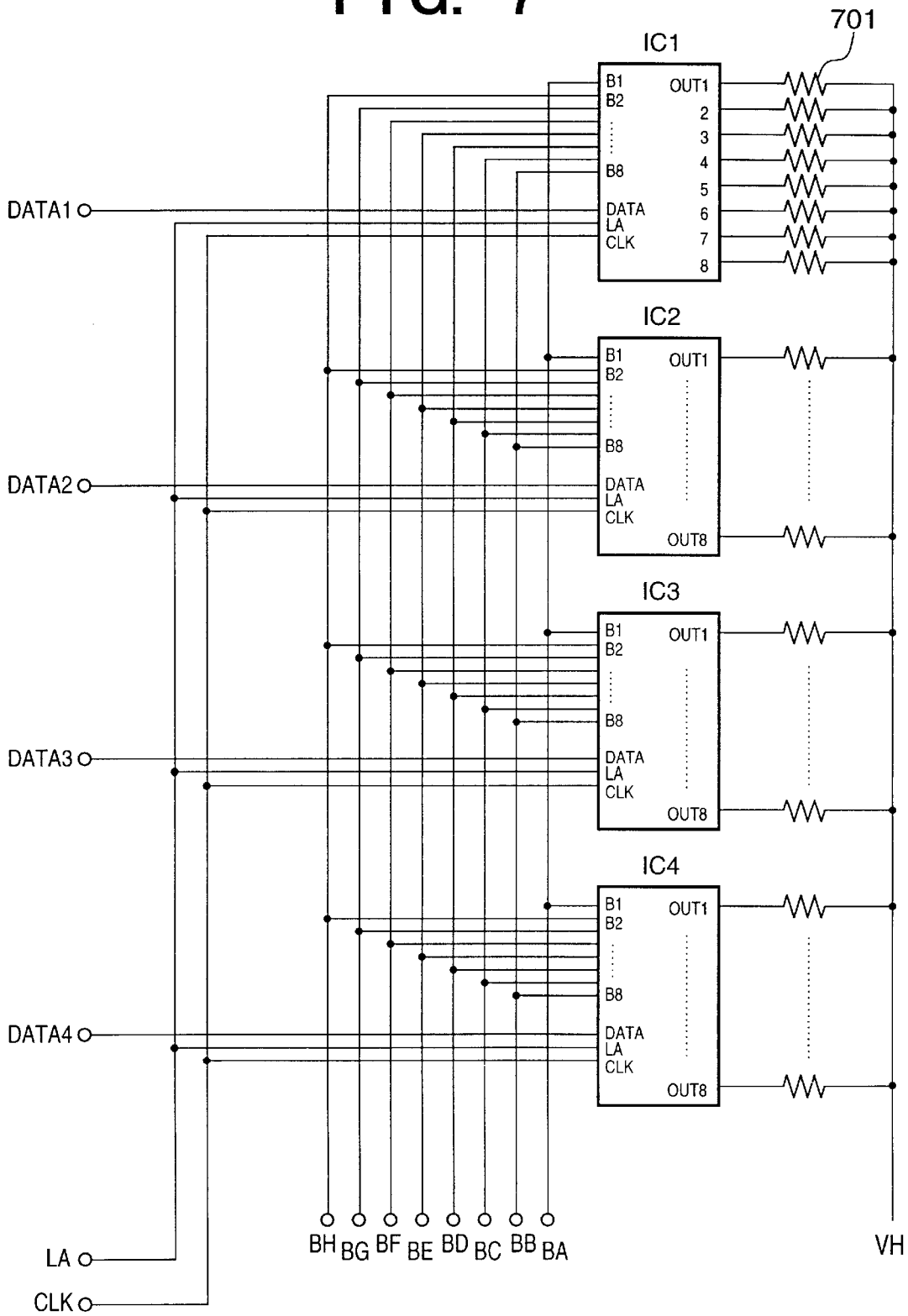
FIG. 7 is an equivalent circuit diagram of a conventional printing head.

The conventional printing head has a nozzle arrangement like the one shown in FIG. 4A, in which the nozzle numbers correspond to the driving block numbers as shown in Table 1 below. FIG. 7 shows an equivalent circuit diagram of the printing head for performing this driving operation. A discharge energy generating element (a heating resistor will be exemplified in this specification and embodiments described below) 701 is disposed for each nozzle to make it discharge ink. The equivalent circuit diagram of a driving circuit in the IC in FIG. 7 will be described later in this embodiment.

TABLE 1

| | | | | | | | | |
|---|---|---|---|---|---|---|---|---|
| Nozzle Number | 1 | 2 | 3 | 4 | 5 | 6 | 7 | 8 |
| Driving Block Number | 9 | 8 | 7 | 6 | 5 | 4 | 3 | 2 |
| Nozzle Number | 9 | 10 | 11 | 12 | 13 | 14 | 15 | 16 |
| Driving Block Number | 1 | 8 | 7 | 6 | 5 | 4 | 3 | 2 |
| Nozzle Number | 17 | 18 | 19 | 20 | 21 | 22 | 23 | 24 |
| Driving Block Number | 1 | 8 | 7 | 6 | 5 | 4 | 3 | 2 |
| Nozzle Number | 25 | 26 | 27 | 28 | 29 | 30 | 31 | 32 |
| Driving Block Number | 1 | 8 | 7 | 6 | 5 | 4 | 3 | 2 |

In this case, the driving block numbers represent the order in which the nozzles are driven in one event. That is, the nozzles are driven in the order of 1, 2, 3, . . . , 8 (BA, BB, . . . , BH in FIG. 7). When an image is printed by multipass (4-pass) printing operation, in which eight nozzles are driven in each pass, using the printing head having these 32 nozzles, nozzles belonging to the same driving block are used in a cycle of eight rasters. Table 2 below shows the nozzles and driving blocks used for printing a raster in each pass.

TABLE 2

| | Nozzle to be Used | | | | Driving Block |
|---|---|---|---|---|---|
| Raster 1 | 1 | 9 | 17 | 25 | 1 |
| Raster 2 | 2 | 10 | 18 | 26 | 8 |
| Raster 3 | 3 | 11 | 19 | 27 | 7 |
| Raster 4 | 4 | 12 | 20 | 28 | 6 |
| Raster 5 | 5 | 13 | 21 | 29 | 5 |
| Raster 6 | 6 | 14 | 23 | 30 | 4 |
| Raster 7 | 7 | 15 | 23 | 31 | 3 |
| Raster 8 | 8 | 16 | 24 | 32 | 2 |

Figure 5:
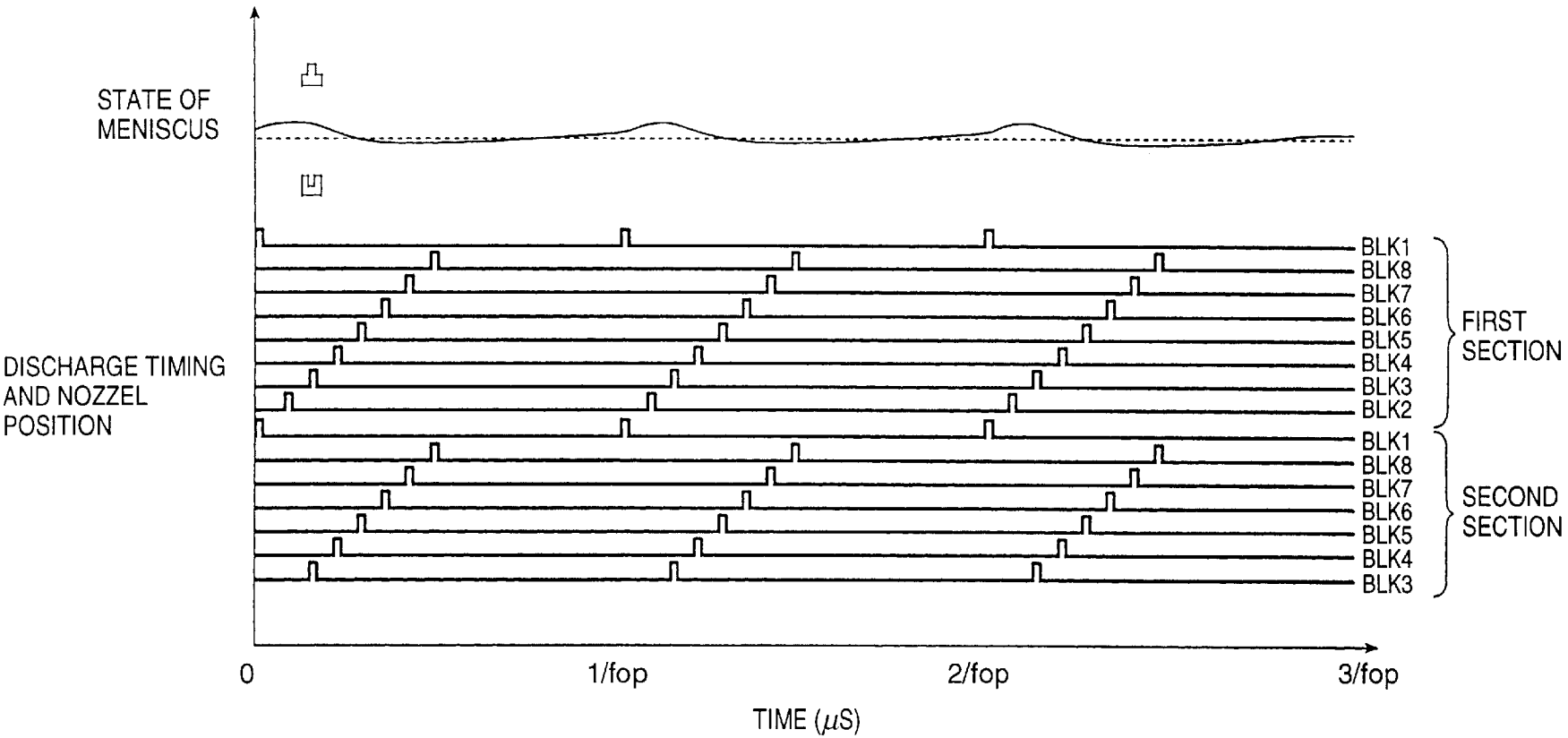
FIG. 5 is a graph showing driving signals for making all the nozzles periodically discharge ink droplets and the state of a meniscus surface as functions of time.

According to this prior art, the same raster is printed by using only nozzles belonging to the same driving block. As a consequence, driving-block-dependent density unevenness due to periodic pressure variations, which has been described with reference to FIG. 5, is accumulated and becomes more conspicuous.

Figures 6A, 6B, 6C:
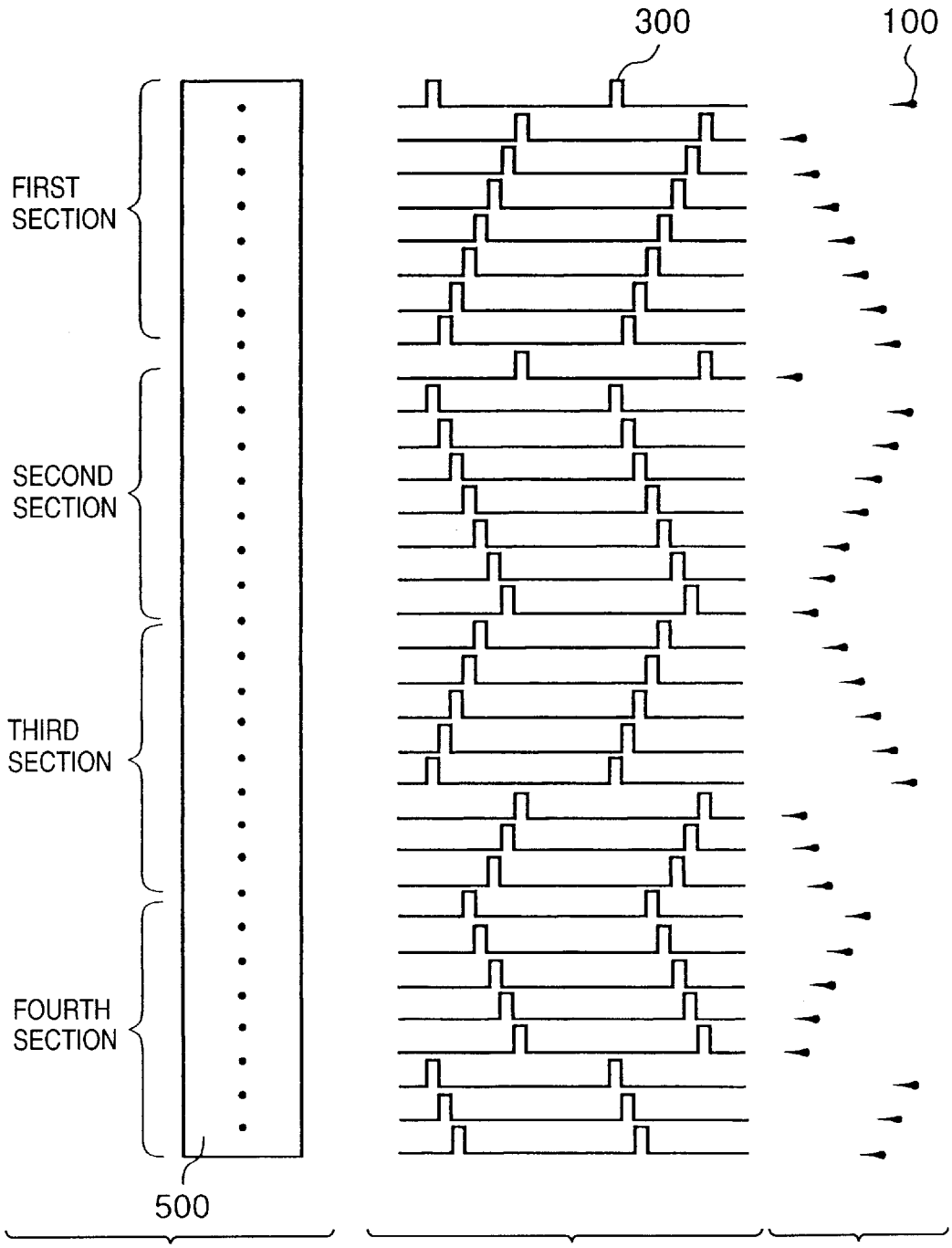
FIGS. 6A to 6C are views schematically showing the nozzle array of the ink-jet printer of the present invention, driving signals for the respective nozzles, and flying ink droplets discharged from the respective nozzles, respectively.
Figure 8:
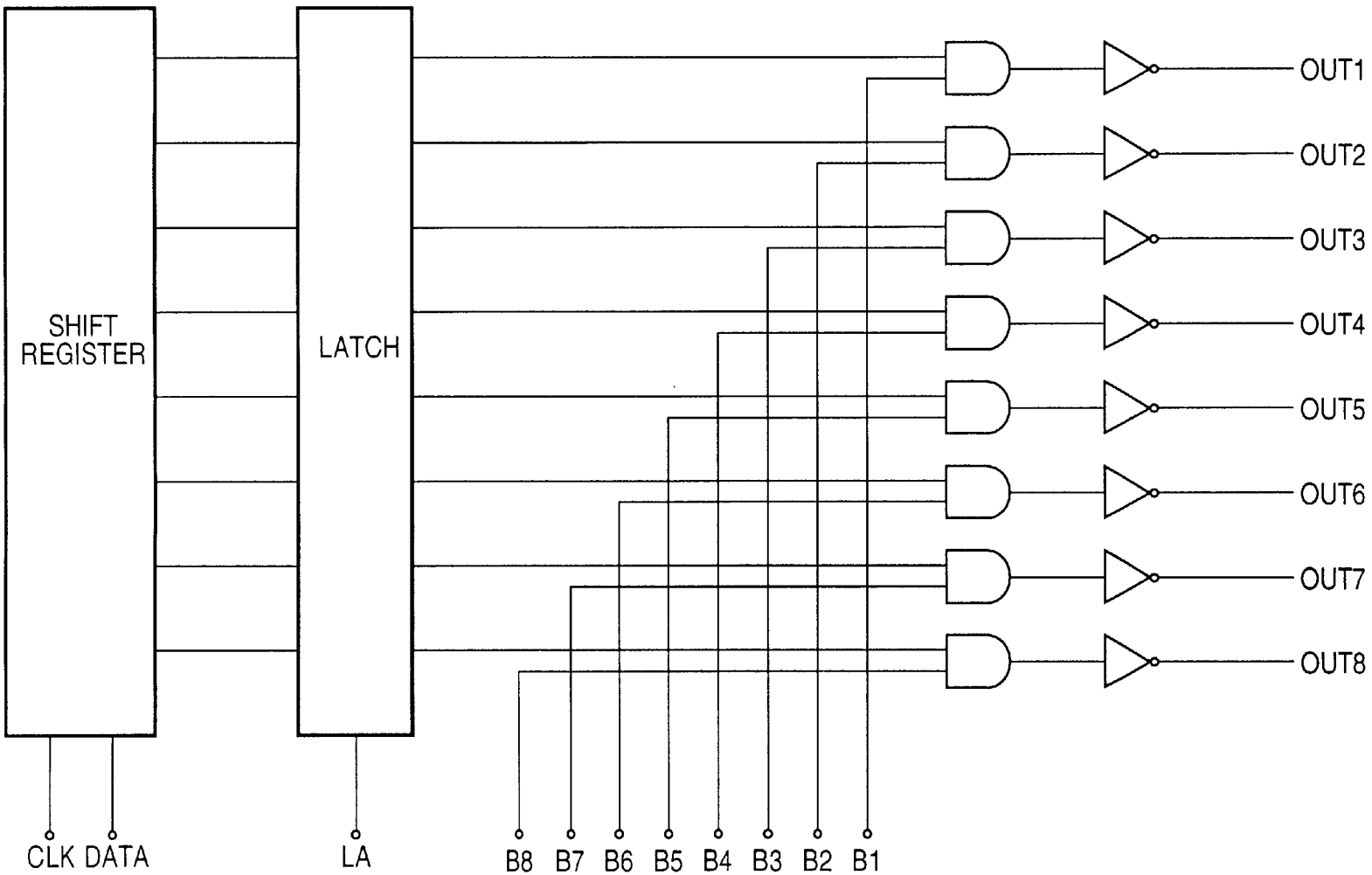
FIG. 8 is a circuit diagram showing the internal arrangement of a printing head driving IC according to an embodiment of the present invention.
Figure 9:
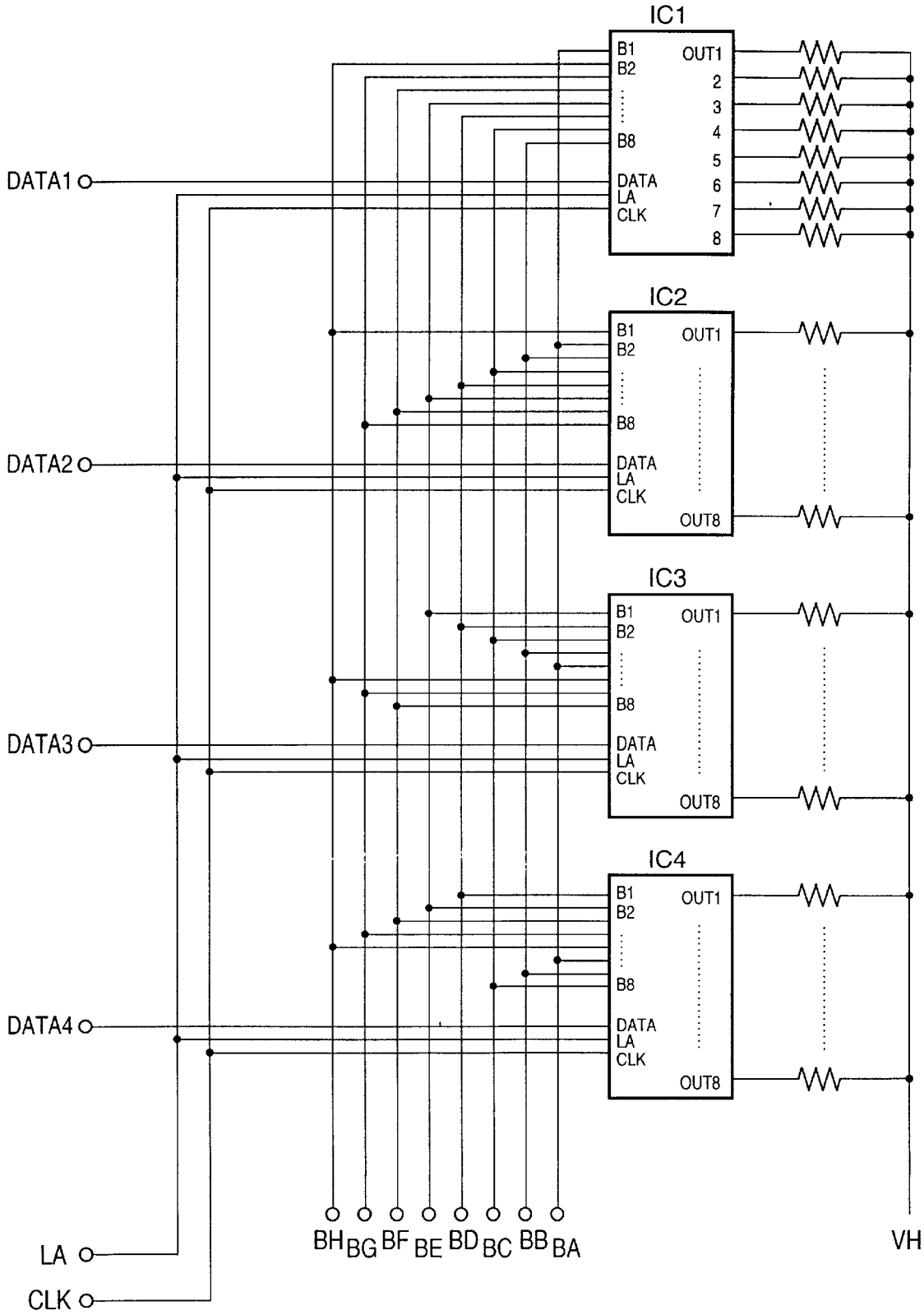
FIG. 9 is an equivalent circuit diagram of the printing head according to the embodiment of the present invention which is driven by the IC in FIG. 8.
Figure 10:
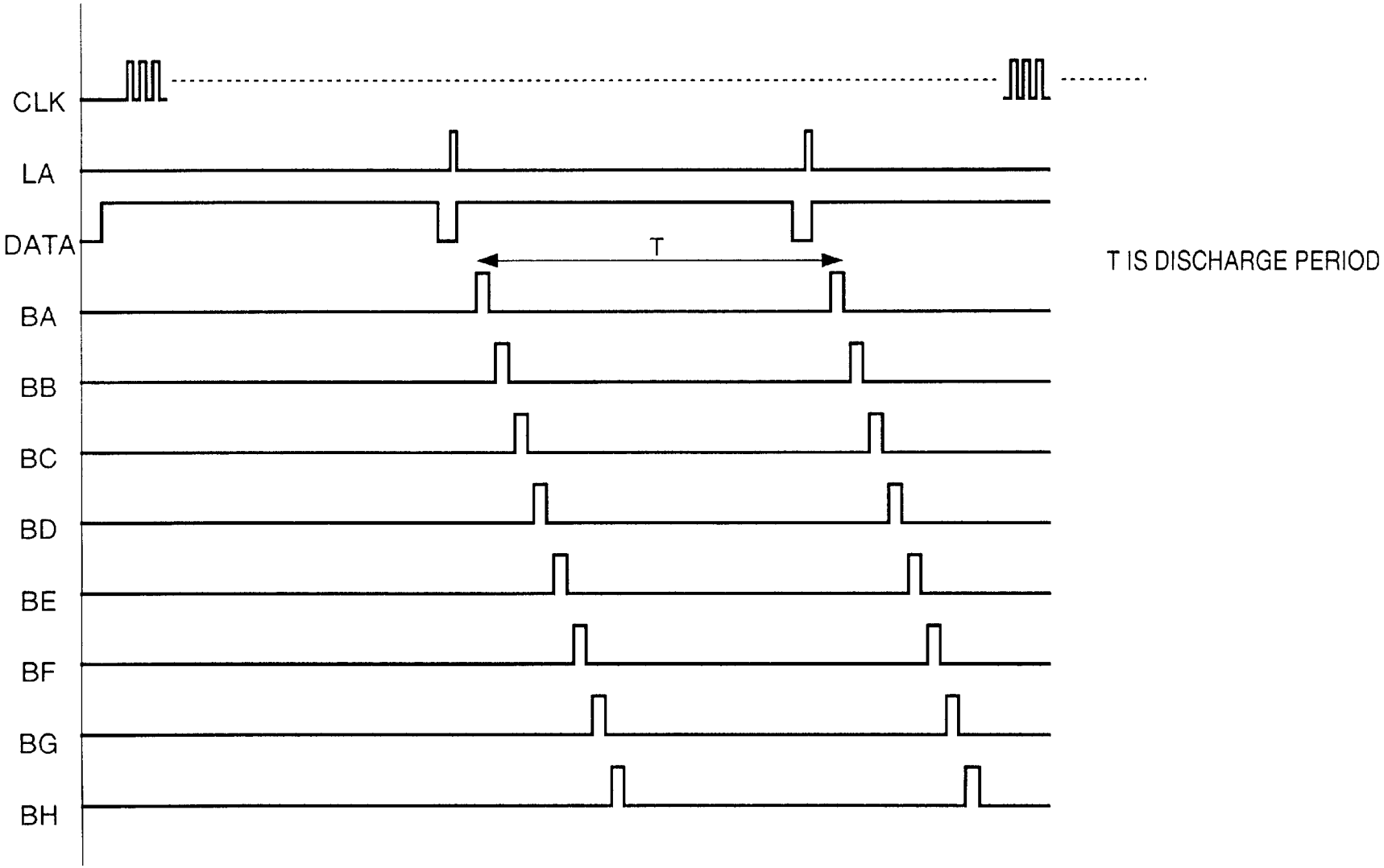
FIG. 10 is a timing chart of signals supplied to the printing head in FIG. 9.

Like FIGS. 4A to 4C, FIGS. 6A to 6C schematically show the nozzle array of the ink-jet printing head, driving signals for the respective nozzles, and flying ink droplets discharged from the respective nozzles. FIGS. 8 to 10 show equivalent circuits for performing driving operation and block driving timings in this embodiment. Referring to FIG. 6A, the nozzle array 500 of the ink-jet printing head is made up of 32 nozzles. These nozzles are grouped into four sections, from the first section to the fourth section, each consisting of eight nozzles, when viewed from the upper side of FIG. 6A.

Each of the eight nozzles in each section belongs to one of the eight driving blocks. In printing operation, these nozzles are time-divisionally driven in units of blocks. That is, nozzles belonging to the same block are driven at once.

This embodiment will be described in detail below with reference to FIGS. 8 to 10, which are circuit diagrams of circuits for driving the printing head of the embodiment and a timing chart. FIG. 8 is a circuit diagram showing the internal arrangement of an IC for driving the printing head. FIG. 9 is an equivalent circuit diagram of the printing head according to the embodiment, which is driven by using the IC in FIG. 8. FIG. 10 is a timing chart for driving the circuit in FIG. 9. In this embodiment, when the printing head prints while it is scanned once in the main scanning direction, pixels on the next line are printed while the printing head is scanned in the main scanning direction after the printing head is moved in the sub-scanning direction by eight pitches. The minimum distance between the nozzles which discharge ink at the same time is eight pitches. That is, eight different driving timings BA, BB, BC, BD, BE, BF, BG and BH (see FIG. 10) are prepared within the same cycle and assigned to each nozzle. Referring to FIG. 8, reference symbol CLK denotes a clock signal and LA, a latch signal, which is sent to the latch when 8-bit data is stored in the shift register.

Reference symbols B1, B2, . . . , B8 denote lines for a print signal, which are assigned to the first to eighth bits, and OUT1 to OUT8 denote output signal terminals.

Referring to FIG. 9, IC 1 is in charge of ink discharging from nozzle number 1 to nozzle number 8; IC 2, in charge of ink discharging from nozzle number 9 to nozzle number 16; IC 3, in charge of ink discharging from nozzle number 17 to nozzle number 24; and IC 4, in charge of ink discharging from nozzle number 25 to nozzle number 32. As shown in FIG. 9, the combination of driving timing signals BA, BB, . . . , BH supplied to the lines B1 to B8 varies for each IC. For example, in IC 1, the driving timing signals BA, BH, BG, BF, BE, BD, BC, and BB are respectively assigned to the lines B1, B2, B3, B4, B5, B6, B7, and B8, whereas in IC 2, the driving timing signals BH, BA, BB, BC, BD, BE, BF, and BG are respectively assigned to the lines B1, B2, B3, B4, B5, B6, B7, and B8 (Table 3).

Table 4 shows specific driving timing signals and specific nozzles driven thereby, which discharge droplets that form lines (rasters) to which the respective pixels on printed matter belong when 4-pass printing is performed by using such a head while it is moved by eight pitches in the sub-scanning direction.

In this embodiment, four ICs are used to drive the 32 nozzles. These ICs are of the same type, but OUTn (n=1 to 8) of the respective ICs are driven at different timings. Since the driving timings are changed to satisfy the requirement in the present invention without increasing the number of types of ICs, this embodiment is advantageous in terms of manufacturing cost.

In this embodiment, one driving timing is required to drive one nozzle in one IC. In a case of a head having many nozzles, however, the same driving timing may be assigned to at least two nozzles of nozzles which are driven by the same IC within the range of the present invention (for example, in a case wherein eight or more nozzles are driven by one IC having eight driving timing signal inputs of lines B1 to B8).

In the case shown in FIGS. 6A to 6C, the respective driving blocks are assigned to the nozzles in the manner indicated by Table 3 below but not periodically assigned as in the prior art. The nozzles are sequentially driven by pulse shaped driving signals 300 shown in FIG. 6B in ascending order from the first driving block to the eighth driving block. As a consequence, ink droplets 100 are discharged from the respective nozzles in accordance with the driving signals, as shown in FIG. 6C.

TABLE 3

| | | | | | | | | |
|---|---|---|---|---|---|---|---|---|
| Nozzle Number | 1 | 2 | 3 | 4 | 5 | 6 | 7 | 8 |
| Driving Block Number | 1 | 8 | 7 | 6 | 5 | 4 | 3 | 2 |
| Nozzle Number | 9 | 10 | 11 | 12 | 13 | 14 | 15 | 16 |
| Driving Block Number | 8 | 1 | 2 | 3 | 4 | 5 | 6 | 7 |
| Nozzle Number | 17 | 18 | 19 | 20 | 21 | 22 | 23 | 24 |
| Driving Block Number | 5 | 4 | 3 | 2 | 1 | 8 | 7 | 6 |
| Nozzle Number | 25 | 26 | 27 | 28 | 29 | 30 | 31 | 32 |
| Driving Block Number | 4 | 5 | 6 | 7 | 8 | 1 | 2 | 3 |

In this embodiment, driving blocks are differently and nonperiodically assigned to the nozzles in the respective nozzle groups, as shown in Table 3. When, therefore, multipass (4-pass) printing operation is performed by driving eight nozzles in each pass as in the prior art, the nozzles are used to print each raster in the manner indicated by Table 4 below.

TABLE 4

| | Nozzle to be Used | | | | Driving Block | | | |
|---|---|---|---|---|---|---|---|---|
| Raster 1 | 1 | 9 | 17 | 25 | 1 | 8 | 5 | 4 |
| Raster 2 | 2 | 10 | 18 | 26 | 8 | 1 | 4 | 5 |
| Raster 3 | 3 | 11 | 19 | 27 | 7 | 2 | 3 | 6 |
| Raster 4 | 4 | 12 | 20 | 28 | 6 | 3 | 2 | 7 |
| Raster 5 | 5 | 13 | 21 | 29 | 5 | 4 | 1 | 8 |
| Raster 6 | 6 | 14 | 23 | 30 | 4 | 5 | 8 | 1 |
| Raster 7 | 7 | 15 | 23 | 31 | 3 | 6 | 7 | 2 |
| Raster 8 | 8 | 16 | 24 | 32 | 2 | 7 | 6 | 3 |

As is obvious from Table 4 as well, unlike the conventional case indicated by Table 2, in this embodiment, the numbers of the four driving blocks used to print each raster are different from each other. As described with reference to FIG. 5, the amounts of ink discharged from the driving blocks belonging to the first half group tend to be large, whereas those belonging to the second half group tend to be small. In contrast to this, according to this embodiment, in printing each raster, the driving blocks are assigned to the nozzles so as not to use only different driving blocks belonging to the first and second half groups.

In this case, in two of four printing passes for printing each raster, driving blocks belonging to the first half group are preferably used, whereas driving blocks belonging to the second half group are preferably used in the two remaining printing passes. In this embodiment, of the eight driving blocks, the driving blocks belonging to the first half group and the driving blocks belonging to the second half group are alternately used. For example, the driving blocks used to print raster 1 are 1, 8, 5, and 4 from pass 1 to pass 4 in the order named, and the driving blocks used to print raster 2 are 8, 1, 4, and 5 from pass 1 to pass 4 in the order named.

In this embodiment, the sum of the block numbers of the four driving blocks used to print each raster is 18 and remains unchanged. In addition, the sum of the block numbers of the two driving blocks used in the first two printing passes of four printing passes and the sum of the block numbers of the two driving blocks used in the second two printing passes are nine. This makes it possible to simplify assignment of four driving blocks by combining a first pair and a second pair.

The correspondence between the respective nozzles and driving blocks and the correspondence between the driving blocks used to print each raster, which are shown in Tables 3 and 4, are managed/controlled by the gate array (G. A.) 1704 for controlling the supply of printing data to the printing head 1708, which has been described with reference to FIG. 2.

As described above, in this embodiment, the driving blocks used to print each raster are proportionally distributed to compensate for variations in printing density due to ink discharge amounts dependent on the driving blocks used at the respective printing ends in four printing passes, thereby reducing density unevenness. More specifically, high-density printing and low-density printing are alternately performed, and each raster is printed by four printing operations in an overlapped state. As a consequence, density differences among the rasters are canceled out, and each raster has an almost uniform average density, thus improving print quality.

In the above embodiment, droplets discharged from the printing head are ink droplets, and a liquid stored in the ink tank is ink. However, the liquid to be stored in the ink tank is not limited to ink. For example, a treatment solution to be discharged onto a printing medium so as to improve the fixing property or water resistance of a printed image or its image quality may be stored in the ink tank.

In the above embodiment, the heating resistors have been exemplified as discharge energy generating elements for discharging ink. However, the present invention is not limited to this. For example, piezoelectric elements or the like may be used.

Each of the embodiments described above has exemplified a printer, which comprises means (e.g., an electrothermal transducer, laser beam generator, and the like) for generating heat energy as energy utilized upon execution of ink discharge, and causes a change in state of an ink by the heat energy, among the ink-jet printers. According to this ink-jet printer and printing method, a high-density, high-precision printing operation can be attained.

As the typical arrangement and principle of the ink-jet printing system, one practiced by use of the basic principle disclosed in, for example, U.S. Pat. Nos. 4,723,129 and 4,740,796 is preferable. The above system is applicable to either one of so-called an on-demand type and a continuous type. Particularly, in the case of the on-demand type, the system is effective because, by applying at least one driving signal, which corresponds to printing information and gives a rapid temperature rise exceeding film boiling, to each of electrothermal transducers arranged in correspondence with a sheet or liquid channels holding a liquid (ink), heat energy is generated by the electrothermal transducer to effect film boiling on the heat acting surface of the printing head, and consequently, a bubble can be formed in the liquid (ink) in one-to-one correspondence with the driving signal. By discharging the liquid (ink) through a discharge opening by growth and shrinkage of the bubble, at least one droplet is formed. If the driving signal is applied as a pulse signal, the growth and shrinkage of the bubble can be attained instantly and adequately to achieve discharge of the liquid (ink) with the particularly high response characteristics.

As the pulse driving signal, signals disclosed in U.S. Pat. Nos. 4,463,359 and 4,345,262 are suitable. Note that further excellent printing can be performed by using the conditions described in U.S. Pat. No. 4,313,124 of the invention which relates to the temperature rise rate of the heat acting surface.

As an arrangement of the printing head, in addition to the arrangement as a combination of discharge nozzles, liquid channels, and electrothermal transducers (linear liquid channels or right angle liquid channels) as disclosed in the above specifications, the arrangement using U.S. Pat. Nos. 4,558,333 and 4,459,600, which disclose the arrangement having a heat acting portion arranged in a flexed region is also included in the present invention. In addition, the present invention can be effectively applied to an arrangement based on Japanese Patent Laid-Open No. 59-123670 which discloses the arrangement using a slot common to a plurality of electrothermal transducers as a discharge portion of the electrothermal transducers, or Japanese Patent Laid-Open No. 59-138461 which discloses the arrangement having an opening for absorbing a pressure wave of heat energy in correspondence with a discharge portion.

Furthermore, as a full line type printing head having a length corresponding to the width of a maximum printing medium which can be printed by the printer, either the arrangement which satisfies the full-line length by combining a plurality of printing heads as disclosed in the above specification or the arrangement as a single printing head obtained by forming printing heads integrally can be used.

In addition, not only an exchangeable chip type printing head, as described in the above embodiment, which can be electrically connected to the apparatus main unit and can receive an ink from the apparatus main unit upon being mounted on the apparatus main unit but also a cartridge type printing head in which an ink tank is integrally arranged on the printing head itself can be applicable to the present invention.

It is preferable to add recovery means for the printing head, preliminary auxiliary means, and the like provided as an arrangement of the printer of the present invention since the printing operation can be further stabilized. Examples of such means include, for the printing head, capping means, cleaning means, pressurization or suction means, and preliminary heating means using electrothermal transducers, another heating element, or a combination thereof. It is also effective for stable printing to provide a preliminary discharge mode which performs discharge independently of printing.

Furthermore, as a printing mode of the printer, not only a printing mode using only a primary color such as black or the like, but also at least one of a multi-color mode using a plurality of different colors or a full-color mode achieved by color mixing can be implemented in the printer either by using an integrated printing head or by combining a plurality of printing heads.

Moreover, in each of the above-mentioned embodiments of the present invention, it is assumed that the ink is a liquid. Alternatively, the present invention may employ an ink which is solid at room temperature or less and softens or liquefies at room temperature, or an ink which liquefies upon application of a use printing signal, since it is a general practice to perform temperature control of the ink itself within a range from 30° C. to 70° C. in the ink-jet system, so that the ink viscosity can fall within a stable discharge range.

In addition, in order to prevent a temperature rise caused by heat energy by positively utilizing it as energy for causing a change in state of the ink from a solid state to a liquid state, or to prevent evaporation of the ink, an ink which is solid in a non-use state and liquefies upon heating may be used. In any case, an ink which liquefies upon application of heat energy according to a printing signal and is discharged in a liquid state, an ink which begins to solidify when it reaches a printing medium, or the like, is applicable to the present invention. In this case, an ink may be situated opposite electrothermal transducers while being held in a liquid or solid state in recess portions of a porous sheet or through holes, as described in Japanese Patent Laid-Open No. 54-56847 or 60-71260. In the present invention, the above-mentioned film boiling system is most effective for the above-mentioned inks.

In addition, the ink-jet printer of the present invention may be used in the form of a copying machine combined with a reader, and the like, or a facsimile apparatus having a transmission/reception function in addition to an image output terminal of an information processing equipment such as a computer.

The present invention can be applied to a system constituted by a plurality of devices (e.g., host computer, interface, reader, printer) or to an apparatus comprising a single device (e.g., copying machine, facsimile machine).

Further, the object of the present invention can also be achieved by providing a storage medium storing program codes for performing the aforesaid processes to a computer system or apparatus (e.g., a personal computer), reading the program codes, by a CPU or MPU of the computer system or apparatus, from the storage medium, then executing the program.

In this case, the program codes read from the storage medium realize the functions according to the embodiments, and the storage medium storing the program codes constitutes the invention.

Further, the storage medium, such as a floppy disk, a hard disk, an optical disk, a magneto-optical disk, CD-ROM, CD-R, a magnetic tape, a non-volatile type memory card, and ROM can be used for providing the program codes.

Furthermore, besides aforesaid functions according to the above embodiments are realized by executing the program codes which are read by a computer, the present invention includes a case where an OS (operating system) or the like working on the computer performs a part or entire processes in accordance with designations of the program codes and realizes functions according to the above embodiments.

Furthermore, the present invention also includes a case where, after the program codes read from the storage medium are written in a function expansion card which is inserted into the computer or in a memory provided in a function expansion unit which is connected to the computer, CPU or the like contained in the function expansion card or unit performs a part or entire process in accordance with designations of the program codes and realizes functions of the above embodiments.

As many apparently widely different embodiments of the present invention can be made without departing from the spirit and scope thereof, it is to be understood that the invention is not limited to the specific embodiments thereof except as defined in the appended claims.

What is claimed is:

1. An ink-jet printing apparatus for printing by scanning a printing head having a plurality of nozzles arranged in a predetermined direction, composed of a plurality of nozzle groups each including continuously arranged plural nozzles in the predetermined direction, each nozzle for discharging an ink droplet, over a printing medium in a direction substantially perpendicular to an arranged direction of said nozzles, comprising:

driving means for time-divisionally driving said nozzles according to block drive timing signals of a plurality of time-divisionally driven blocks of said plurality of nozzles, wherein said driving means includes a circuit for determining a relationship between nozzle positions in each of said nozzle groups and a driving sequence of said nozzles in each of said nozzle groups, such that a driving sequence of said nozzles in one of said nozzle groups is different from a driving sequence of said nozzles in another of said nozzle groups, and wherein when multipass printing is performed by scanning different nozzles over each printing area a plurality of times, said driving means drives nozzles used to print the same raster according to block drive timing signals of at least two different blocks.

2. The ink-jet printing apparatus according to claim 1, wherein said driving means drives said nozzles used to print the same raster according to block drive timing signals of different blocks.

3. The ink-jet printing apparatus according to claim 1, wherein when numbers are assigned to the blocks in a driving sequence, the numbers of the blocks for driving said nozzles used to print the same raster are constituted by a pair of a number belonging to a first half group and a number belonging to a second half group.

4. The ink-jet printing apparatus according to claim 1, wherein when numbers are assigned to the blocks in a driving sequence, the sum of the numbers of the blocks for driving said nozzles used to print the same raster remains unchanged among the respective rasters.

5. The ink-jet printing apparatus according to claim 1, wherein the number of times of scanning in the multipass printing operation is an even number.

6. The ink-jet printing apparatus according to claim 1, wherein the number of blocks is a number obtained by dividing the number of nozzles by the number of times of scanning.

7. The ink-jet printing apparatus according to claim 1, wherein the numbers of the blocks for driving said nozzles used to print the same raster are complementary to each other between two adjacent rasters.

8. The ink-jet printing apparatus according to claim 1, wherein said printing head discharges ink by using thermal energy and comprises an electrothermal transducer for each nozzle, said electrothermal transducer being used to generate thermal energy applied to ink.

* * * * *

UNITED STATES PATENT AND TRADEMARK OFFICE

CERTIFICATE OF CORRECTION

PATENT NO. : 6,439,687 B1
DATED : August 27, 2002
INVENTOR(S) : Takashi Inoue

It is certified that error appears in the above-identified patent and that said Letters Patent is hereby corrected as shown below:

Drawings,
Sheet 5, Figure 5, “NOZZEL” should read -- NOZZLE --.

Column 4,
Line 8, “rater” should read -- raster --.

Signed and Sealed this

Twenty-second Day of April, 2003

JAMES E. ROGAN
*Director of the United States Patent and Trademark Office*